US007234739B2

(12) United States Patent
Saitoh et al.

(10) Patent No.: US 7,234,739 B2
(45) Date of Patent: Jun. 26, 2007

(54) MAGNETIC LATCH ASSEMBLY

(75) Inventors: Masatoshi Saitoh, Saitama (JP); Tohru Negishi, Saitama (JP)

(73) Assignee: Washin Optical Co., Ltd., Tokyo (JP)

( * ) Notice: Subject to any disclaimer, the term of this patent is extended or adjusted under 35 U.S.C. 154(b) by 87 days.

(21) Appl. No.: 11/053,873

(22) Filed: Feb. 10, 2005

(65) Prior Publication Data

US 2006/0175842 A1 Aug. 10, 2006

(51) Int. Cl.
*E05C 17/56* (2006.01)

(52) U.S. Cl. ..... 292/251.5

(58) Field of Classification Search ..... 292/251.5; 24/303

See application file for complete search history.

(56) References Cited

U.S. PATENT DOCUMENTS

| | | | | |
|---|---|---|---|---|
| 2,673,111 | A | 3/1954 | Teetor | |
| 4,622,726 | A * | 11/1986 | Nakamura | 24/574.1 |
| 5,035,451 | A | 7/1991 | Brady | |
| 5,485,733 | A * | 1/1996 | Hoffman | 70/276 |
| 5,711,556 | A | 1/1998 | Masters | |
| 6,048,004 | A | 4/2000 | Kaufman et al. | |
| 6,292,985 | B1 | 9/2001 | Grunberger | |
| 6,659,516 | B2 * | 12/2003 | Wang et al. | 292/251.5 |
| 6,929,291 | B2 * | 8/2005 | Chen | 292/251.5 |

FOREIGN PATENT DOCUMENTS

| | | |
|---|---|---|
| DE | 1553544 | 7/1969 |
| EP | 0923887 | 6/1999 |
| FR | 2722232 | 1/1996 |
| JP | 2002-038802 A | 2/2002 |

* cited by examiner

*Primary Examiner*—Gary Estremsky
(74) *Attorney, Agent, or Firm*—Carrier, Blackman & Associates, P.C.; Joseph P. Carrier; William D. Blackman

(57) ABSTRACT

A magnetic latch assembly includes a latch member movably mounted to a first object such as a door, and a retainer arranged in a second, opposing object such as a door frame. The latch member includes a latch arm, a hook formed on the distal end of the latch arm, and a first magnet mounted in the hook. The retainer includes a housing with a cavity and a second magnet. The cavity includes a first horizontal passage and a second vertical passage communicated with the horizontal passage. The second magnet has a magnetic pole of opposite polarity from the magnetic pole of the first magnet. When the first and second objects are relatively moved toward each other, the latch arm is moved into the first passage of the cavity. When the latch head is completely received in the first passage, the two magnets are operatively associated to cause the latch member to be moved from the horizontal passage to the vertical passage and urge the latch member or head into latching engagement with one end of the housing which serves as a retainer.

9 Claims, 9 Drawing Sheets

MAGNETIC LATCH ASSEMBLY

BACKGROUND OF THE INVENTION

The present invention generally relates to locking devices and more particularly to, a magnetic latch assembly for selectively locking and unlocking doors, lids or other similar closures.

Various magnetic latches have heretofore been proposed and implemented to secure doors, container lids, cabinets in a closed position. For example, U.S. Pat. No. 2,673,111 discloses a magnetic door catch adapted for use on cabinet doors of the blind panel type. The magnetic door catch includes a magnetically permeable metal or armature plate secured to the inner surface of a door and a magnet unit pivotably mounted to a door jamb opposing the door. The magnet unit has an elongated frame in which a magnet is mounted. When the door is in its open position, the magnet unit hangs on a straight slant with the bottom end of the housing disposed inwardly from the front face of the door jamb. When the door is moved to its closed position, the magnetic attraction between the armature plate and the magnet causes the entire magnet unit to pivot to a substantially vertical position. In that position, the armature plate and the magnet are attracted to one another to hold the door in its closed position. To open the door, the door is pushed inwardly until the armature plate comes into contact with the door jamb. This causes the magnet to be dislodged from the armature plate. A spring is disposed in the magnet unit and is adapted to be deflected or compressed rearwardly when the armature plate is positioned in contact with the door jamb. When the pressure on the door is abruptly released, the spring urges the door toward its open position.

U.S. Pat. No. 5,035,451 discloses a magnetic latch which includes a latch arm pivotably mounted to a door and having a hook at its one end and a spring leg at its other end. A flat magnet and a retainer in the form of a hook are attached to a cabinet. In the event of a disturbance such as an earthquake, the latch arm is pivotably moved in an upward direction and attracted to the magnet. If the door is moved further in an outward direction, the latch arm is brought into latching engagement with the retainer to prevent the slippage of the contents of the cabinet.

Many of conventional latch assemblies are complicate in structure and have various moving parts.

Accordingly, it is an object of the present invention to provide a magnetic latch assembly which is simple in structure and can smoothly and effectively latch two relatively movable objects.

SUMMARY OF THE INVENTION

To achieve the foregoing object, the present invention provides a magnetic latch assembly which includes a first latch means and a second latch means operatively associated with the first latch means to selectively latch and unlatch two relatively movable first and second objects such as a combination of a door and a door frame and a combination of a container and a closure lid.

The first latch means is arranged in the first object, and the second latch means is in the form of a retainer arranged in the second object. The first latch means includes a latch member movably mounted to the first object, and a first magnet arranged in the latch member. The retainer has a housing within which a cavity is defined to receive at least part of the latch member when the first and second objects are moved toward one another. The cavity has a first passage and a second passage extending in a direction substantially perpendicular to the first passage. A second magnet is mounted in the housing and has a magnetic pole of opposite polarity from the first magnetic pole of the first magnet. The latch member is moved into the first passage of the cavity when the first and second objects are relatively moved toward each other. The first magnet and the second magnet are then operatively associated to cause the latch member to be moved from the first passage to the second passage. Advantageously, when the latch member reaches the second passage, the attractive force between the first and second magnets urges the latch member into latching engagement with one end of the housing which serves as a hook or retainer.

In a preferred embodiment, the latch member includes an elongated latch arm with a hook formed at its distal end. The first magnet is mounted in the hook.

In a preferred embodiment, the housing has a through aperture communicated with the cavity so that the latch member is accessible through the aperture. When the first and second objects are held in their latched position, the latch member is manually pressed down with sufficient force to disengage the first magnet from the second magnet. As a result, the latch member is moved toward the first passage of the cavity to allow removal of the latch member from the cavity or housing. As an alternative, a discrete release member may be inserted through the aperture. The release member may be engaged with the latch member when the first and second objects are held in their latched position. The release member may be manually pushed down with sufficient force to disengage the first magnet from the second magnet.

In a preferred embodiment, the housing has a bore communicated with the cavity. A release member is inserted into the bore. The second magnet is mounted in the release member. When the two objects are held in their latched position, one end of the release member extends out of the housing and the other end of the release member is substantially flush with the cavity. When the release member is pulled in a direction away from the cavity, the second magnet is disengaged from the first magnet. As a result, the latch member is moved from the second passage to the first passage of the cavity. This allows removal of the latch member from the housing.

BRIEF DESCRIPTION OF THE DRAWINGS

The above and other objects, features and advantages of the present invention will be apparent from the following description of preferred embodiments when taken in conjunction with the accompanying drawings.

DETAILED DESCRIPTION OF THE INVENTION

Figure 1:
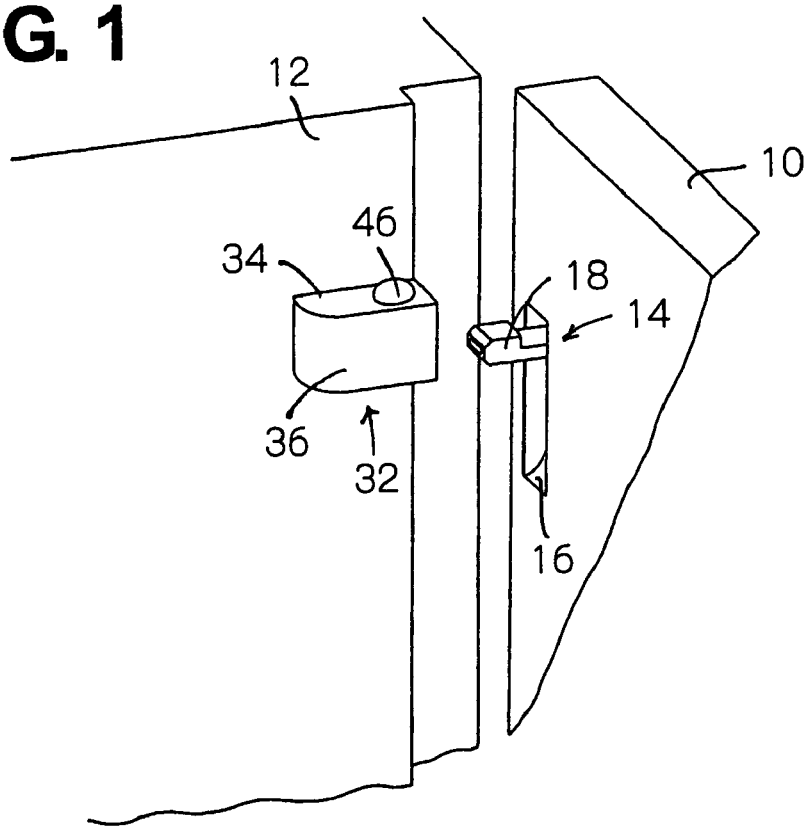
FIG. 1 is a perspective view of a magnetic latch assembly according to a first embodiment of the present invention, with a door in its open or unlatched position.

A preferred embodiment of the present invention will now be described with reference to the figures, where like reference numerals indicate identical or functionally similar elements.

Figure 2:
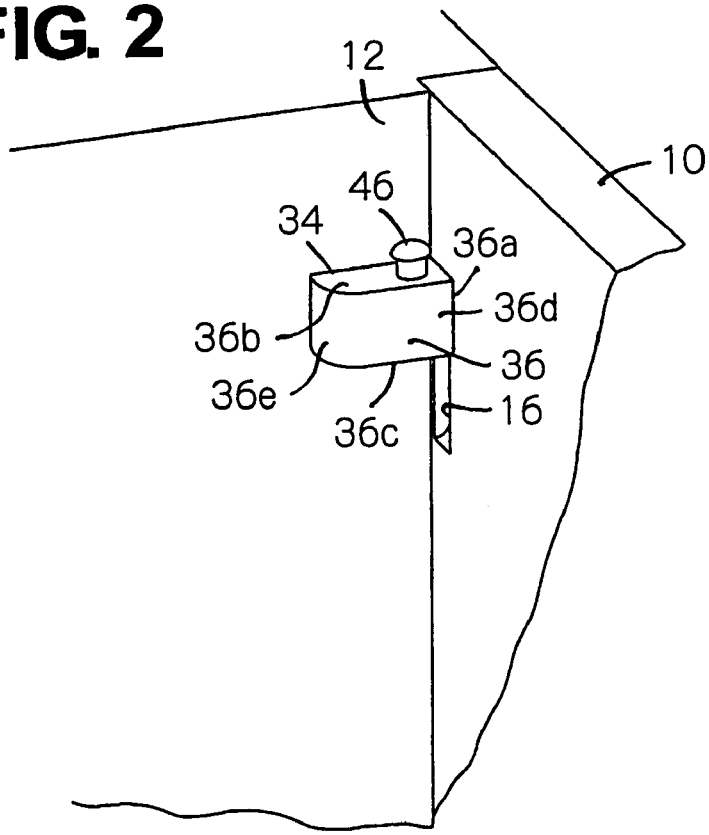
FIG. 2 is a view similar to that of FIG. 1, but with the door in its closed or latched position.

Referring first to FIGS. 1 and 2, a door 10 is hingedly connected at its one lateral edge (not shown) to a door jamb or frame 12 to swing about a vertical axis. The door 10 is provided with a first latch means as generally designed by reference numeral 14. The first latch means 14 includes an elongated vertical recess 16 defined in the upper left corner of the inside surface of the door 10 and a movable latch member 18 contained within the recess 16 when the door 10 is in an open or unlatched position as shown in FIG. 3.

Referring to FIGS. 3 to 6, the latch member 18 has an elongated latch arm 20, a pair of lateral pivot pins 22 (only one is shown in FIGS. 3 to 6) extending outwardly from opposite sides of the proximal end of the latch arm 20, and a generally rectangular hook 24 formed on the distal end of the latch arm 20. A rectangular magnet 26 is embedded in the hook 24 and has, for example, a north magnetic pole. The outer end of the magnet 26 is substantially flush with or slightly outwardly extends from the outer end of the hook 24. As shown, the hook 24 has taper outer edges. A horizontal guide groove 28 is defined in the door 10 behind the recess 16 and communicated with the recess 16. The proximal end of the latch arm 20 is received in the horizontal guide groove 28 when the latch arm 20 is in its horizontal orientation as shown best in FIG. 5. Also, a pair of vertical guide grooves 30 (only one is shown in FIGS. 3 to 6) are defined within the door 10 and located at opposite sides of the recess 16.

Figure 4:
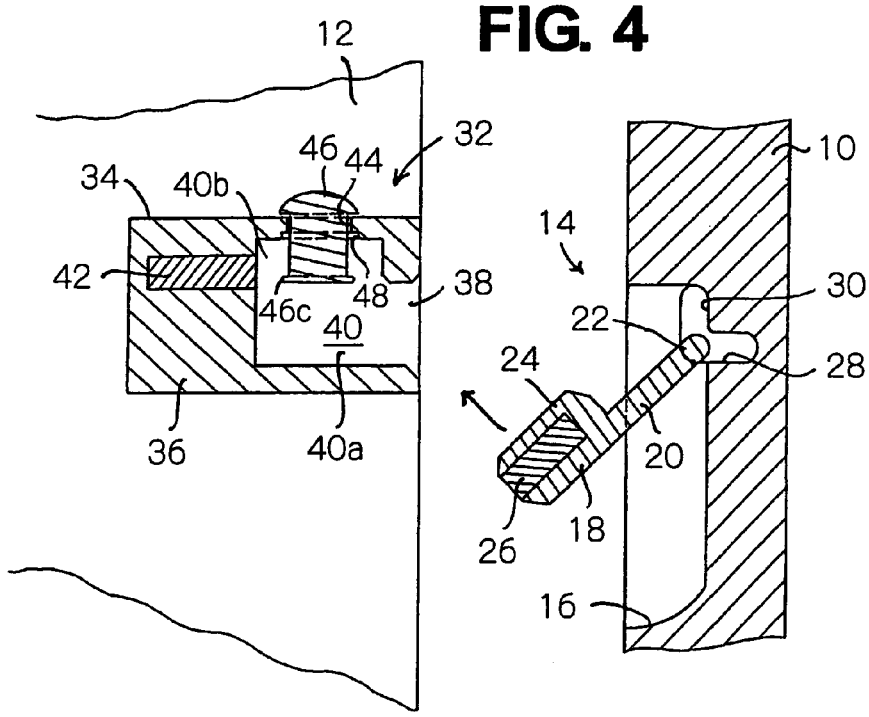
FIG. 4 is a sectional view, on an enlarged scale, of the magnetic latch assembly wherein the latch member is pivotably moved out of the door.
Figure 5:
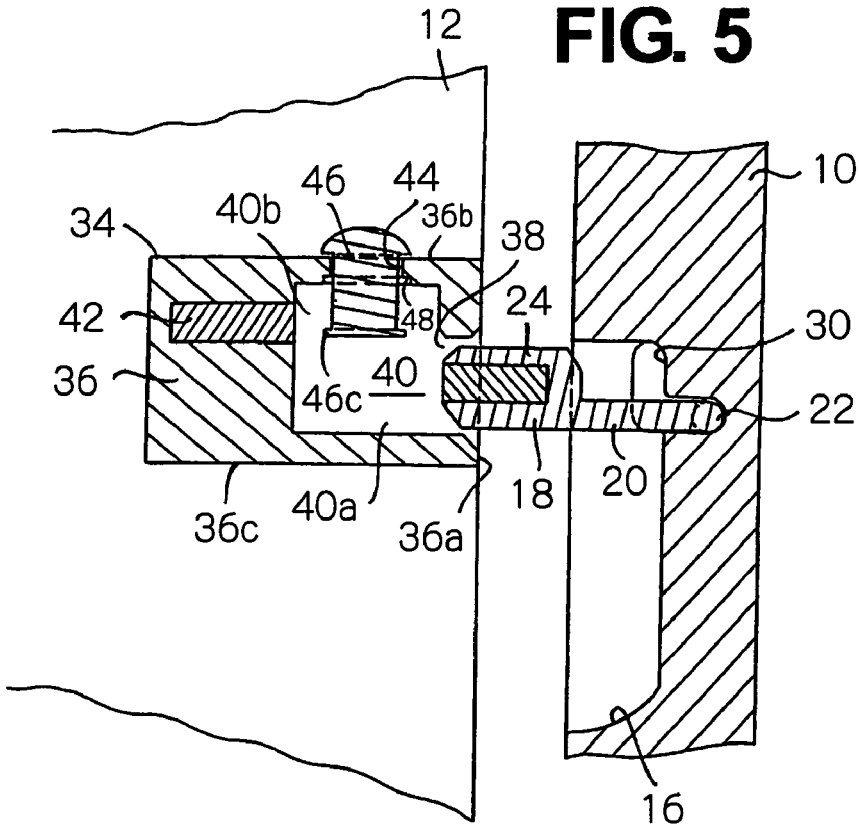
FIG. 5 is a sectional view, on an enlarged scale, of the magnetic latch assembly wherein the latch member is partly inserted into a retainer as the door is moved toward a door frame.
Figure 6:
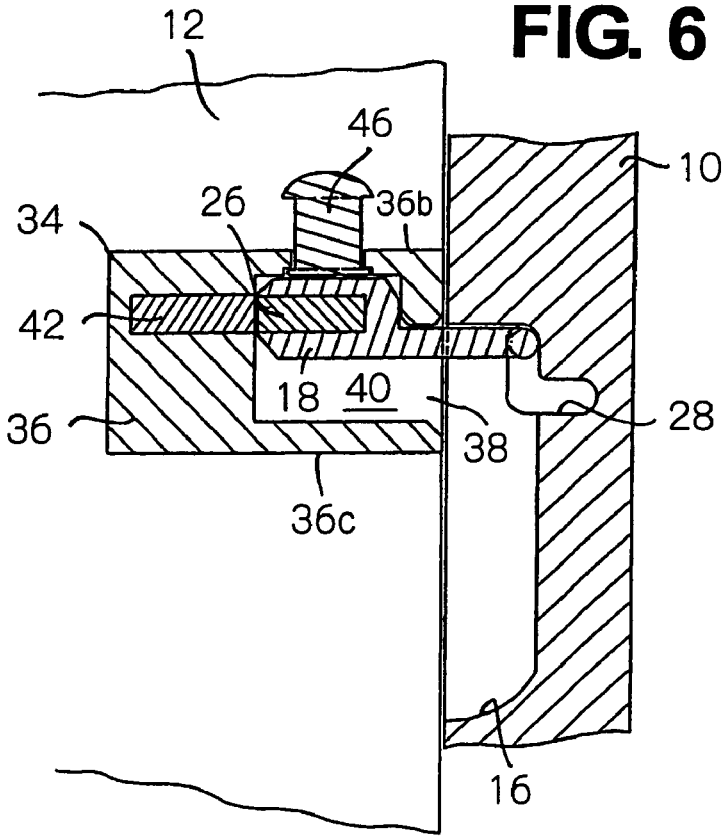
FIG. 6 is a sectional view, on an enlarged scale, of the magnetic latch assembly wherein the latch member is fully engaged with the retainer to lock the door.

Referring back to FIGS. 1 and 2, the door frame 12 is provided with a second latch means 32 in the form of a retainer 34. The retainer 34 includes a substantially rectangular housing 36 secured to the door frame 12 by any securing means such as screws and adhesives (not shown). Specifically, the housing 36 has a vertical front wall 36*a* (see FIGS. 3 to 6), a horizontal top and bottom walls, 36*b*, 36*c*, a vertical inner wall (not shown) fixedly mounted onto the inside surface of the door frame 12, and an outer wall 36*d*, and a rear wall 36*e*. As shown, the outer wall 36*d* and the rear wall 36*e* of the housing 36 collectively form a curved corner therebetween. A rectangular front opening or open mouth 38 is defined in the front wall 36*a* of the housing 36 to receive the latch member 18. To facilitate insertion of the latch member 18 into the housing 36, the open mouth 38 has a taper peripheral edge. As shown in FIGS. 3 to 6, the housing 36 has a L-shaped cavity 40 communicated with the opening 38. The cavity 40 has a first, horizontal passage 40*a* and a second, vertical passage 40*b* connected to the horizontal passage 40*a* and extending in a direction substantially perpendicular to the horizontal passage 40*a*. A rectangular magnet 42 is horizontally embedded in the housing 36 and opens to the cavity 40. The magnet 42 has, for example, a south magnetic pole. To allow the passage of the hook 24 of the latch member 18 into cavity 40, the horizontal passage 40*a* has a cross sectional area slightly greater than that of the hook 24 of the latch member 18. Also, the vertical passage 40*b* has a cross sectional area slightly greater than that of the hook 24 so as to receive the hook 24 when the door 10 is in its latched position as shown in FIG. 6. The top wall 36*b* of the housing 36 is formed with a through aperture 44. A release member 46 is partly inserted into the cavity 40 through the circular aperture 44 and supported by the top wall 36*b* of the housing 36. More specifically, the release member 46 has a cylindrical shank 46*a* extending through the aperture 44, a semispherical head 46*b* secured to the upper end of the shank 46*a* and adapted to rest on the top wall 36*b* of the housing 36 when the door 10 is in its unlatch position as shown in FIGS. 3 to 5, and an annular flange 46*c* extending around the lower end of the shank 46*a*. The top wall 36*b* of the housing 36 is formed at its bottom surface with an annular recess 48. The annular recess 48 has a diameter greater than that of the through aperture 44 and also, slightly greater than that of the annular flange 46*c*. The depth of the annular recess 48 is substantially equal to the thickness of the annular flange 46*c* of the release member 46. The annular flange 46*c* and the semispherical head 46*b* collectively prevent removal of the release member 46 from the top wall 36*b* of the housing 36.

Figure 3:
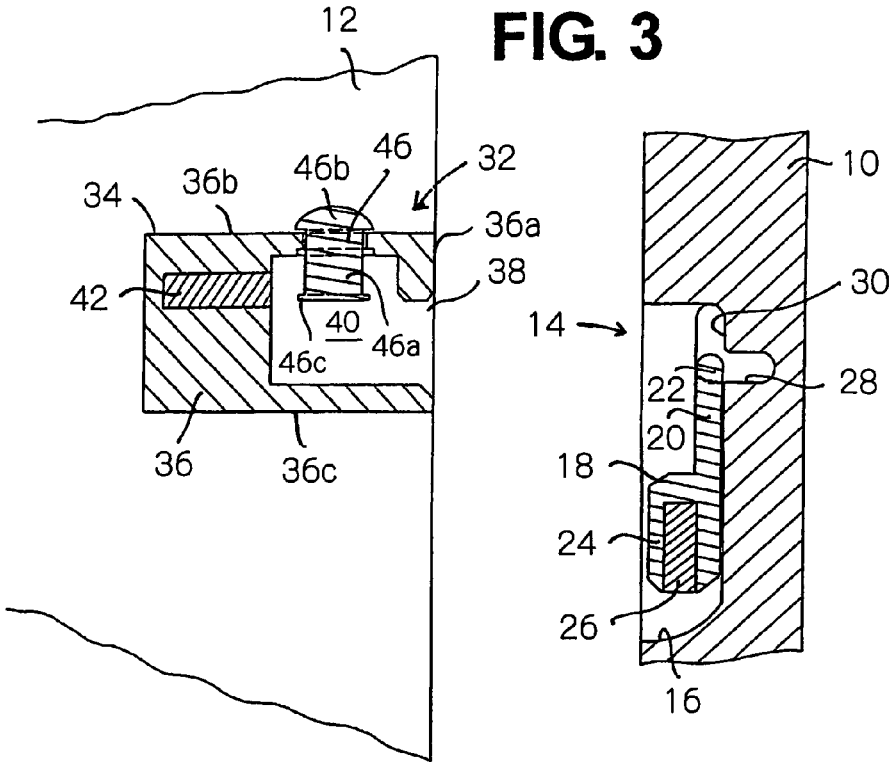
FIG. 3 is a sectional view, on an enlarged scale, of the magnetic latch assembly wherein a latch member is contained within the door.

To lock the door 10 from the position shown in FIG. 3, the latch member 18 is pulled out of the recess 16 manually by the index or other fingers of a user. Then, the latch member 18 is upwardly pivoted about the pivot pins 22 as shown in FIG. 4. At this time, the pivot pins 22 are located in the lower end of the vertical guide grooves 30. The latch member 18 is rotated in a clockwise direction in FIG. 4 until the latch arm 20 is horizontally aligned with the horizontal guide groove 28. The latch arm 20 is inserted into the horizontal guide groove 28 until the proximal end of the latch arm 20 makes contact with the rear or bottom end of the horizontal guide groove 28. With the latch member 18 in its horizontal orientation, the door 10 is moved toward the door frame 12, as shown in FIG. 5. This causes the latch member 18 to be inserted into the retainer housing 36 through the opening or open mouth 38. The latch member 18 is slidably moved on the bottom of the cavity 40 until the outer end of the hook 24 makes contact with the rear wall of the cavity 40 or the horizontal passage 40*a*. As mentioned earlier, the magnet 42 has a magnetic pole of opposite polarity from the magnetic pole of the magnet 26. The resulting attractive force between the magnets 26, 42 causes upward movement of the latch member 18 within the cavity 40. At this time, the pivot pins 22 are moved along the respective vertical guide grooves 30. When the hook 24 of the latch member 18 is fully received within the vertical passage 40*b* of the cavity 40 as shown in FIG. 6, the magnets 26, 42 are attracted to one another to aid in holding the latch member 18 in that position. The hook 24 is hingedly engaged with the upper or retaining end of the front wall 36*a* of the housing 36 so as to securely latch or lock the door 10. At this time, the annular flange 46*c* of the release member 46 is retracted or received within the recess 48 of the top wall 36*b* of the housing 36, and the semi-spherical head 44*b* is upwardly moved and disengaged from the top wall 36*a* of the housing 36.

To unlatch the door 10 from the position shown in FIG. 6, the released member 46 is manually pressed down with sufficient force to overcome the attractive force between the magnets 26, 42. As a result, the magnet 26 is separated from the magnet 42 to allow downward movement of the latch member 18 within the cavity 40 while the pivot pins 22 of the latch member 18 are moved downwardly along the respective vertical guide grooves 30. With the latch arm 20 in contact with the bottom of the cavity 40, the door 10 is pivoted toward its open position. This causes the latch member 18 to be moved out of the cavity 40. As soon as the latch member 18 is separated from the retainer housing 36, the latch member 18 is downwardly pivoted about the pivot pins 22. The latch member 18 is thereafter received within the elongated recess 16.

In the illustrated embodiment, the magnetic latch assembly, preferably as an auxiliary security lock, is mounted on near the upper end of the door. As an alternative, the magnetic latch assembly may be mounted on near the bottom end of the door. Still alternatively, two magnetic latch assemblies may be mounted on both the upper and bottom ends of the door for improved security. Also, it is to be understood that the hook may be made of a magnetically permeable or ferromagnetic metal such as iron and steel. This arrangement eliminates the use of the magnet.

Figure 7:
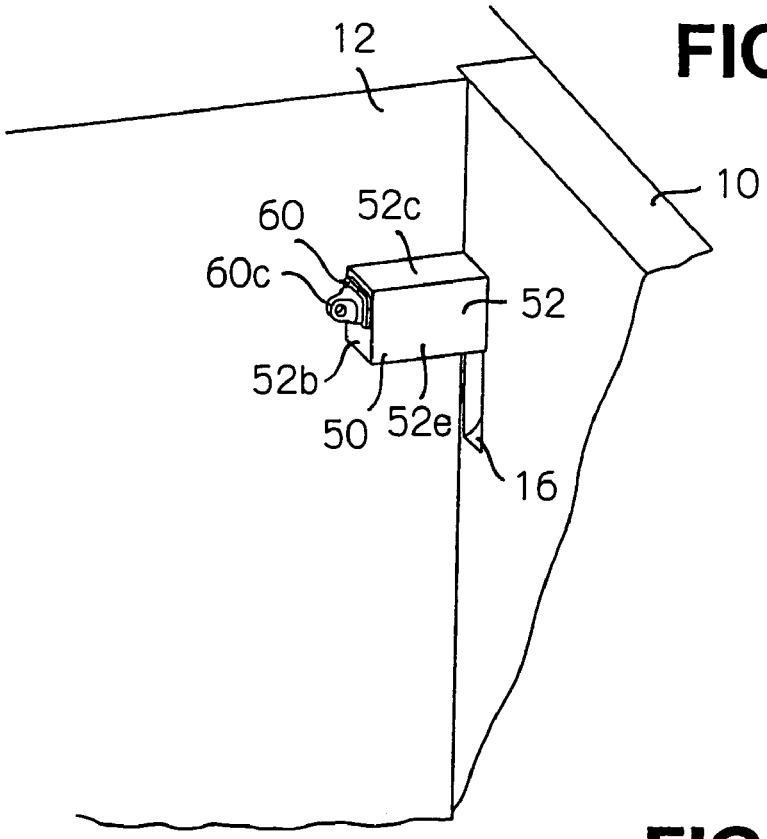
FIG. 7 is a perspective view of a magnetic latch assembly according to a second embodiment of the present invention, with a door in its closed or latched position.
Figure 8:
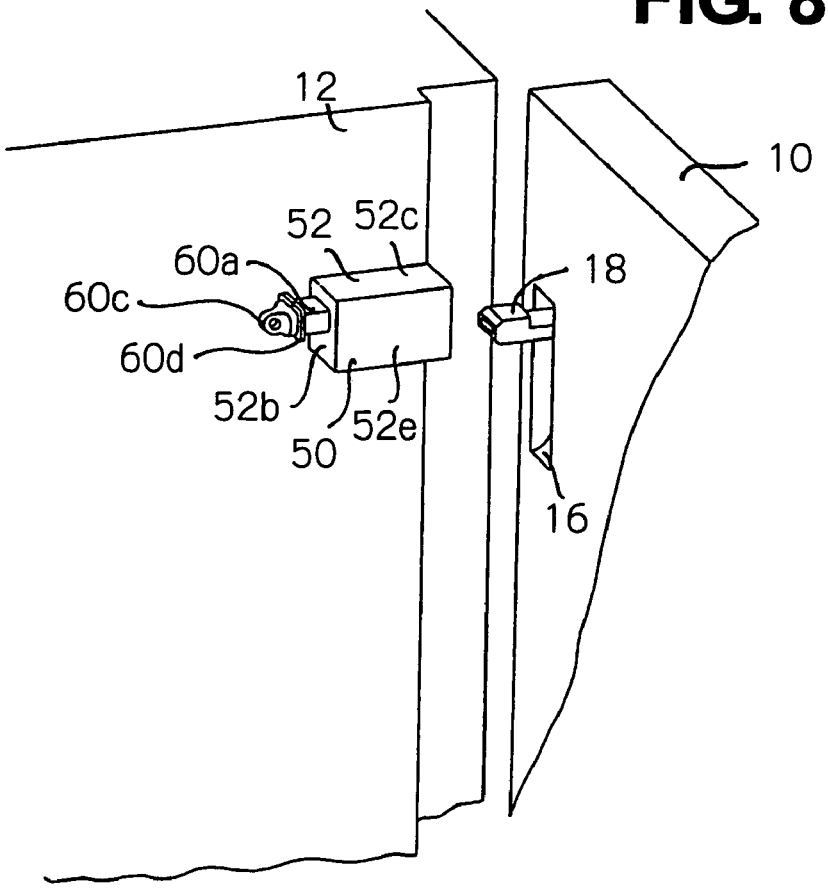
FIG. 8 is a view similar to that of FIG. 7, but with the door in its open or unlatched position.

Referring next to FIGS. 7 and 8, there is shown a magnetic latch assembly according to a second embodiment of the present invention. The latch member of this embodiment is identical in structure to that of the previous embodiment and therefore, will not be described herein. As in the previous embodiment, a retainer 50 as a second latch means is mounted on the door frame 12. The retainer 50 includes a rectangular housing 52 with vertical front and rear walls 52*a*, 52*b*, horizontal top and bottom walls 52*c*, 52*d*, a vertical inner wall (not shown) secured on the inside surface of the door frame 12, and an outer side wall 52*e*.

Figure 9:
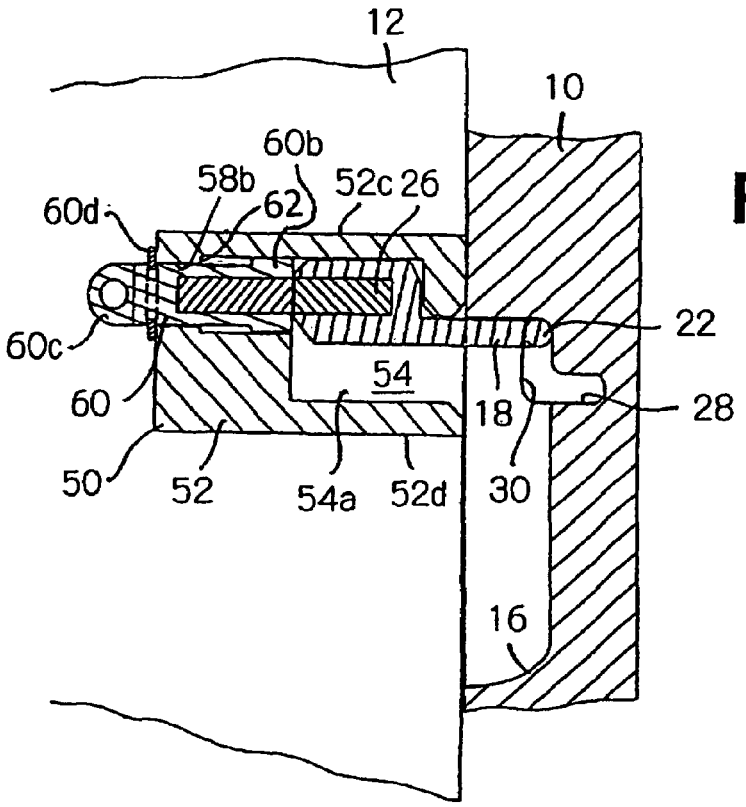
FIG. 9 is a sectional view of the magnetic latch assembly shown in FIG. 7.
Figure 10:
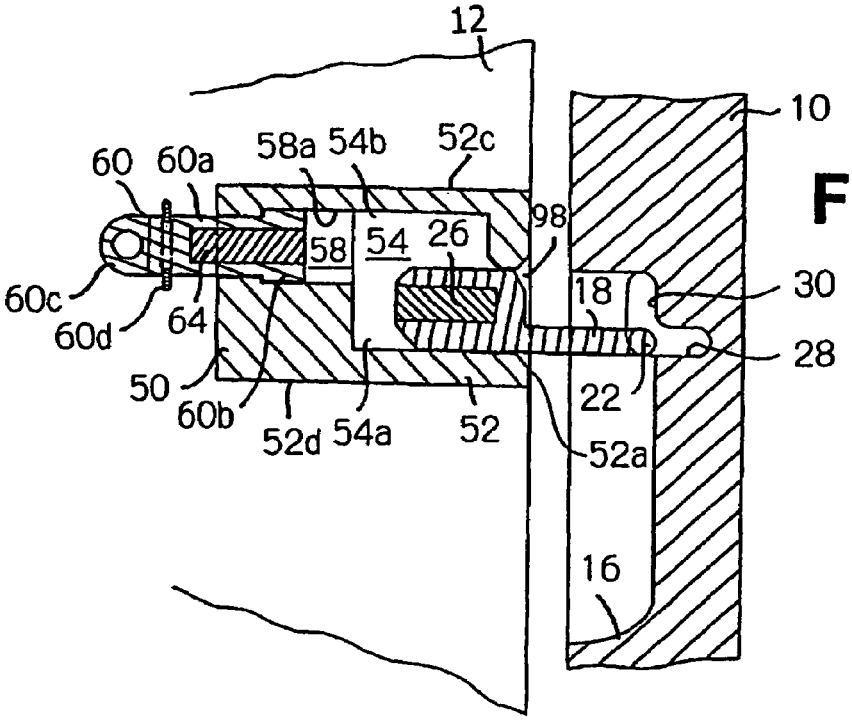
FIG. 10 is sectional view of the magnetic latch assembly shown in FIG. 8.

As shown in FIGS. 9 and 10, the housing 52 has a L-shaped cavity 54 composed of a relatively long horizontal passage 54*a* and a relatively short vertical passage 54*b* extending upwardly from the inner end of the horizontal passage 54*a*, as in the first embodiment. A front opening 56 is defined in the front wall 52*a* of the housing 52 and communicated with the horizontal passage 54*a* of the cavity 54. A horizontal through bore 58 is defined in the rear wall 52*b* of the housing 52 to receive a release member 60. The horizontal bore 58 has a rectangular cross section and is composed of a large diameter section 58*a* communicated directly with the cavity 54 and a small diameter section 58*b* communicated with the large diameter section 58*a*. A shoulder or step 62 is formed between the large and small diameter sections 58*a*, 58*b*. The release member 60 includes a rectangular shank 60*a* with an enlarged front end 60*b*. The enlarged end 60*b* of the shank 60*a* has a cross sectional area slightly less than that of the large diameter section 58*a* of the bore 58, and the remaining part of the shank 60*a* has a cross sectional area slightly less than that of the small diameter section 58*b* of the horizontal bore 58. An apertured tab or knob 60*c* is secured to the rear end of the shank 60*a* and has a rectangular flange 60*d*. A magnet 64 is contained in the shank 60*a* and opens to the cavity 54. The shank 60*a* of the release member 60 is completely contained within the through bore 58 during latching of the door 10. As shown in FIG. 9, the flange 60*d* is held in contact with the rear wall 52*b* of the housing 52 so that the front end of the shank 60*a* is substantially flush with the front end of the through bore 58 in order not to prevent vertical movement of the latch member 18 within the cavity 54.

In use, the latch member 18 is operated in a manner identical to that of the first embodiment during latching of the door 10. To unlatch the door 10, with the knob 60*c* grabbed by the user, the release member 60 is pulled toward the user with sufficient force to overcome the attractive force between the magnets 26, 64, as shown in FIG. 10. This causes immediate drop of the latch member 18 within the cavity 54. As in the previous embodiment, the latch member 18 is slid out of the cavity 54 while the door 10 is pivoted toward its open position. As soon as the latch member 18 is separated from the retainer 50, the latch member 18 is downwardly pivoted about the pivot pins 22. As a result, the latch member 18 is received within the recess 16.

Figure 11:
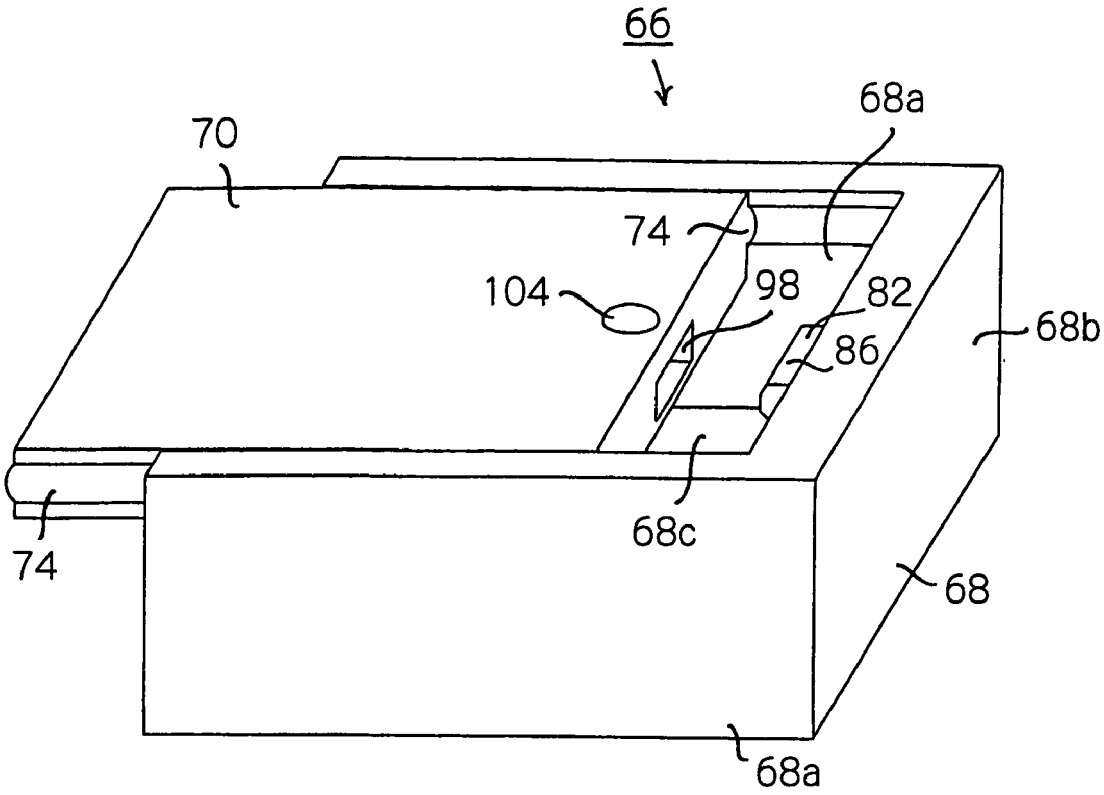
FIG. 11 is a perspective view of a magnetic latch assembly according to a third embodiment of the present invention, with a container lid in its unlatched position.
Figure 12:
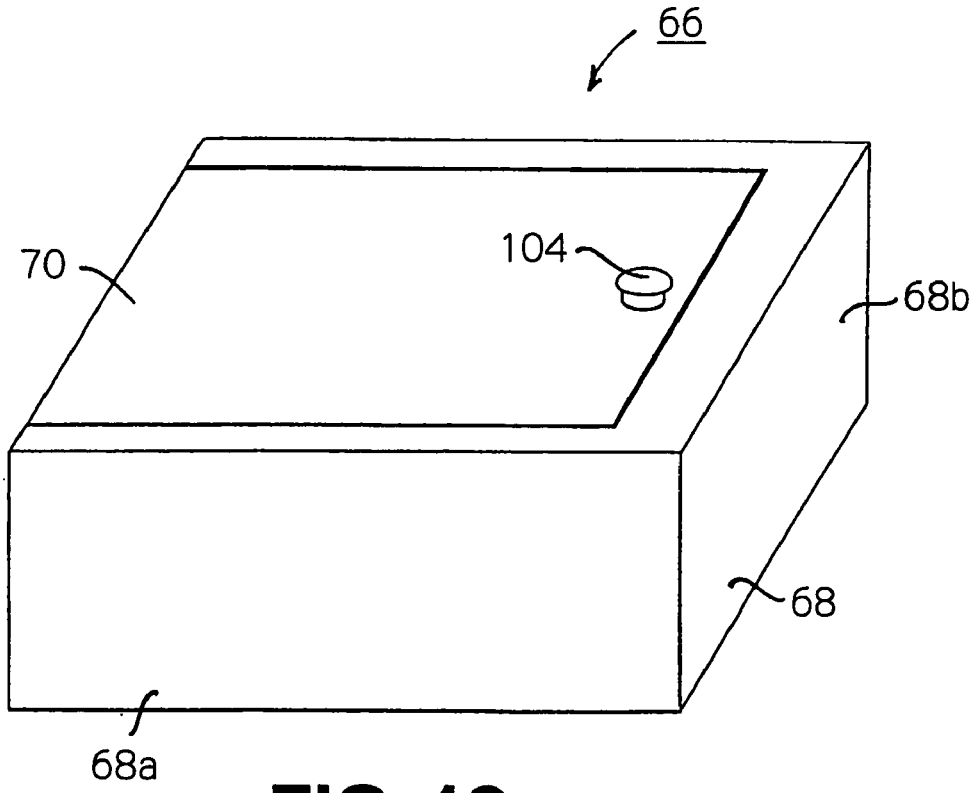
FIG. 12 is a view similar to FIG. 11, but with the lid in its latched position.

Referring to FIGS. 11 and 12, there is shown a magnetic latch assembly according to a third embodiment of the present invention, as applied to a container 66. The container 66 includes a rectangular container body 68 and an associated closure lid 70 slidably movable on the container body 68 to selectively open and close the container. Specifically, the container body 68 has opposite longitudinal side walls 68*a*, opposite lateral side walls 68*b* (only one is shown), a bottom wall 68*c* connected to the four side walls, and an open top 68*d*. As shown better in FIG. 11, a pair of semicircular guide grooves 72 (only one is shown) are defined in the longitudinal side walls 68*a* of the container body 68 adjacent to the open top 68*d*. The closure lid 70 is formed on its longitudinal side edges with a corresponding pair of semicircular projections 74. The opposite projections 74 are slidably received within the respective guide grooves 72 so that the closure lid 70 is selectively moved between an open or unlatched position (see FIG. 11) and a closed or latched position (see FIG. 12). One of the lateral side walls 68*b* is lower than the other side wall so that the closure lid 70 is inserted from the lower side wall of the container body 68. The difference in height between the two lateral side walls 68*b* is substantially equal to the thickness of the closure lid 70.

Figure 13:
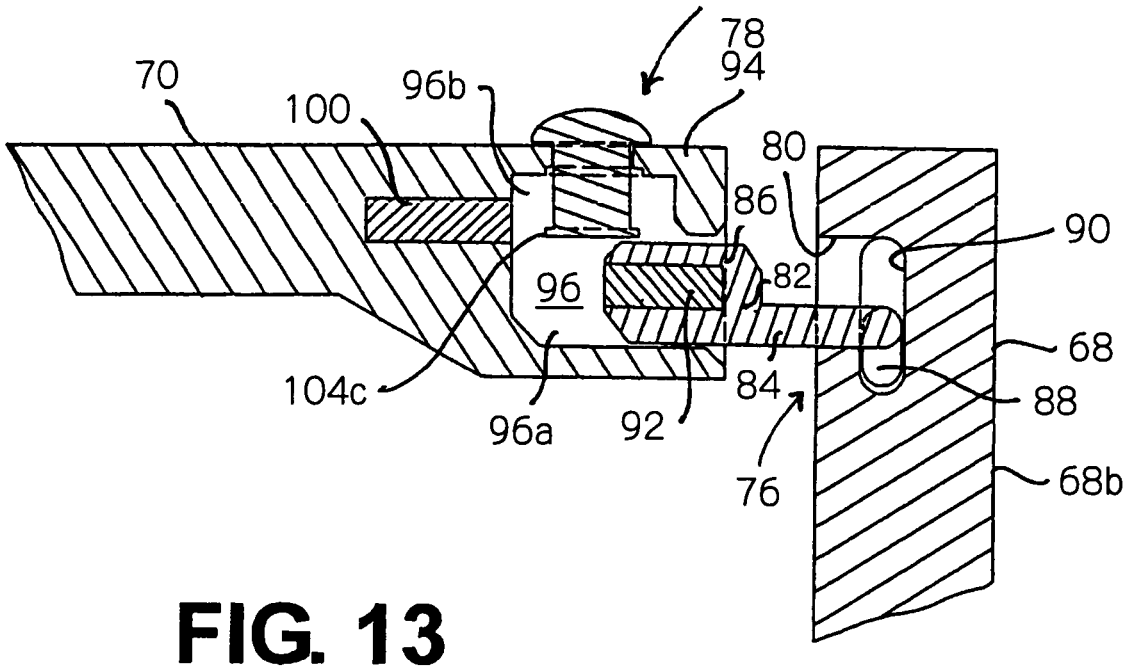
FIG. 13 is a sectional view, on an enlarged scale, of the magnetic latch assembly shown in FIG. 11.
Figure 14:
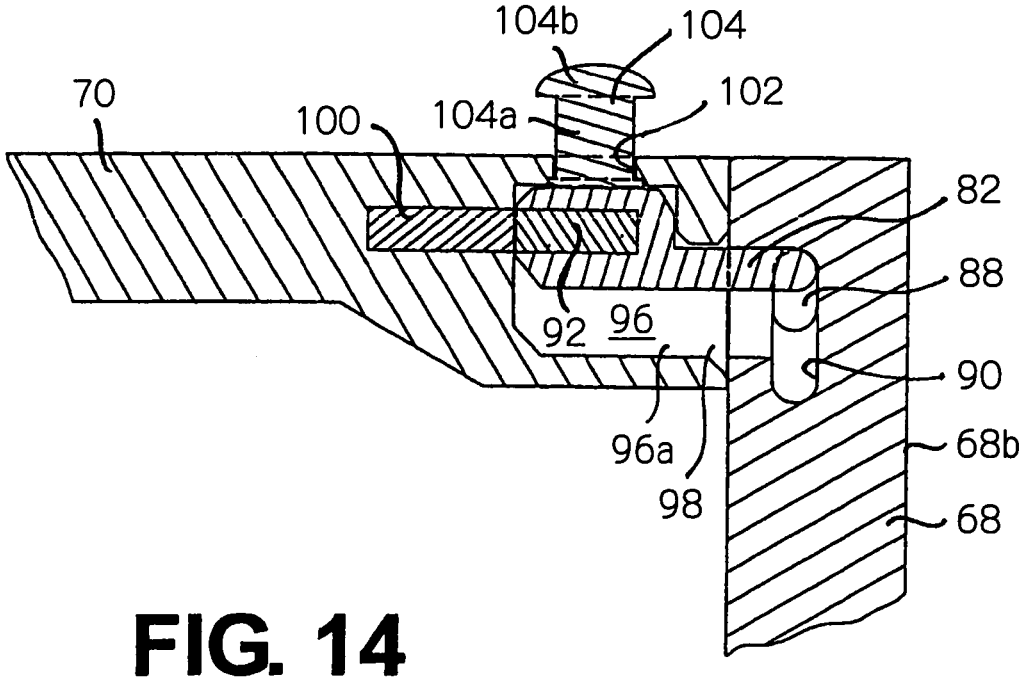
FIG. 14 is a sectional view, on an enlarged scale, of the magnetic latch assembly shown in FIG. 12.

As shown better in FIGS. 13 and 14, a first latch means 76 is arranged in one of the side walls 68*b* of the container body 68, and a second latch means 78 is arranged in the closure lid 70. It is to be understood that the first latch means may be arranged in the closure lid, whereas the second latch means may be arranged in the container body. In the illustrated embodiment, the first latch means 76 includes a vertical recess 80 defined in the inner surface of the side wall 68*b* of the container body 68, and a movable latch member 82 mounted to the side wall 68*b* of the container body 68 and vertically movable along the vertical recess 80. The latch member 82 includes an elongated latch arm 84, a hook 86 formed on the distal end of the latch arm 84, and a pair of opposite ellipsoidal elements or holders 88 extending downwardly from the proximal end of the latch arm 84. A pair of ellipsoidal guide grooves 90 are defined within the side wall 68*b* of the container body 68 and located at opposite sides of the recess 80. The ellipsoidal elements 88 are received within the respective guide grooves 90 so that the latch member 82 is constantly held in a horizontal orientation. As in the previous embodiments, a rectangular magnet 92 is embedded in the hook 86 of the latch member 82 and has an outer end substantially flush with or slightly extending outwardly from the distal end of the latch arm 84. As shown, the hook 86 has taper outer edges.

The second latch means 78 is in the form of a housing or retainer 94 arranged in one of the lateral sides of the closure lid 70 adjacent to the latch member 82. As shown in FIGS. 13 and 14, the second latch means 78 is substantially identical in structure to that used in the first embodiment. However, the second latch means used in this embodiment is slidably moved toward the first latch means, whereas in the first embodiment, the first latch means is pivotably moved toward the second latch means. More specifically, the retainer 94 includes a L-shaped cavity 96 defined in the lateral end of the lid 70 and composed of a horizontal passage 96*a* and a vertical passage 96*b* extending upwardly from the inner end of the horizontal passage 96*a*. The front edge of the closure lid 70 is formed with a front opening or mouth 98 to receive the latch member 82 and is communicated with the cavity 96. A magnet 100 is embedded in the closure lid 70 behind the cavity 96. The outer end of the magnet 100 is substantially flush with the rear wall of the cavity 96. A circular through aperture 102 is defined in the lid 70 above the cavity 96 and communicated with the cavity 96. A release member 104 is inserted through the circular aperture 102 and includes a cylindrical shank 104*a*, a semispherical head 104*b* secured to the upper end of the shank 104*a*, and an annular flange 104*c* extending around the lower end of the shank 104*a*.

To close or latch the closure lid 70, the lid 70 is slidably moved toward the latch member 82 as shown in FIG. 11. Further movement causes the latch member 82 to be inserted into the cavity 96 through the front opening 98 of the lid 70. Once the latch member 82 makes contact with the rear wall of the cavity 96, the attractive force between the magnets 92, 100 causes upward movement of the latch member 82 along the vertical passage 96*b* of the cavity 96. As a result, the hook 86 of the latch member 82 is brought into contact with the top wall of the cavity 96. At this time, the magnets 92, 100 are attracted to one another, and the hook 86 is engaged with the front or retaining edge of the closure lid 70. Also, the head 104*b* of the release member 104 is disengaged from the upper surface of the closure lid 70, as shown in FIG. 14.

To open or unlatch the closure lid 70 from the position shown in FIG. 14, the release member 104 is manually press down with sufficient force to overcome the attractive force between the magnets 92, 100. As a result, the magnet 92 is disengaged from the magnet 100, and the latch member 82 is downwardly moved until the latch member 82 makes contact with the bottom wall of the cavity 96. This allows the closure lid 70 to be slidably moved away from the latch member 82.

Figure 15:
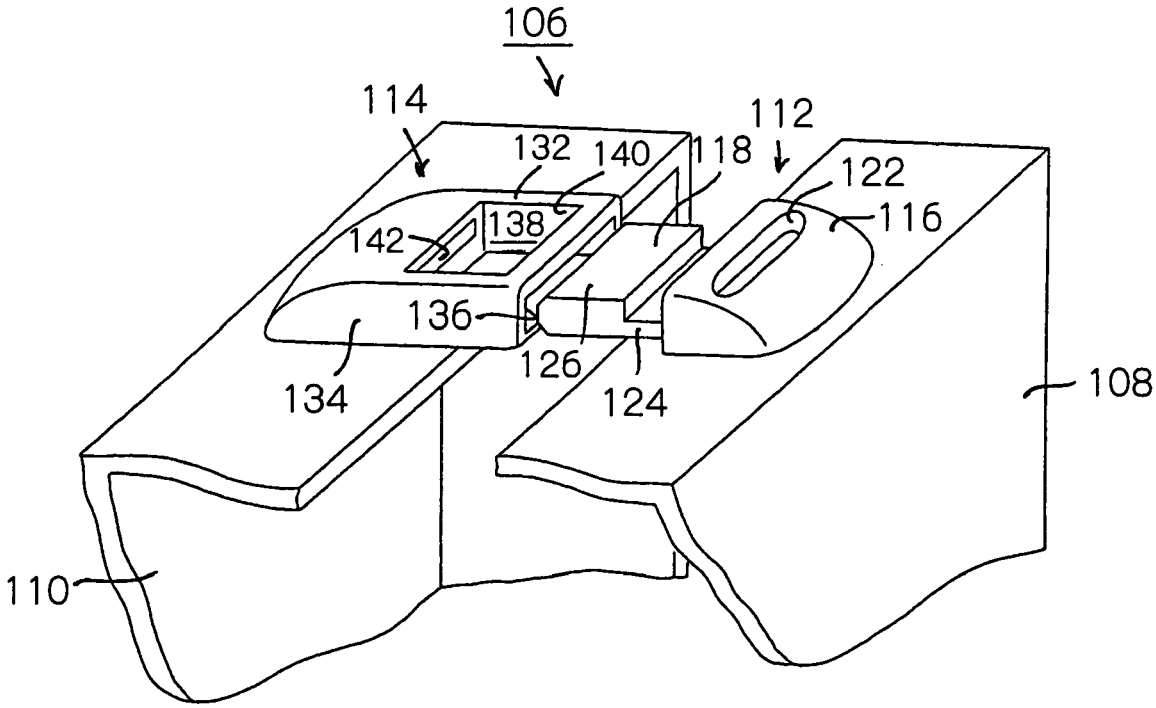
FIG. 15 is a perspective view of a magnetic latch assembly according to a fourth embodiment of the present invention, with an attache case in its open or unlatched position.
Figure 16:
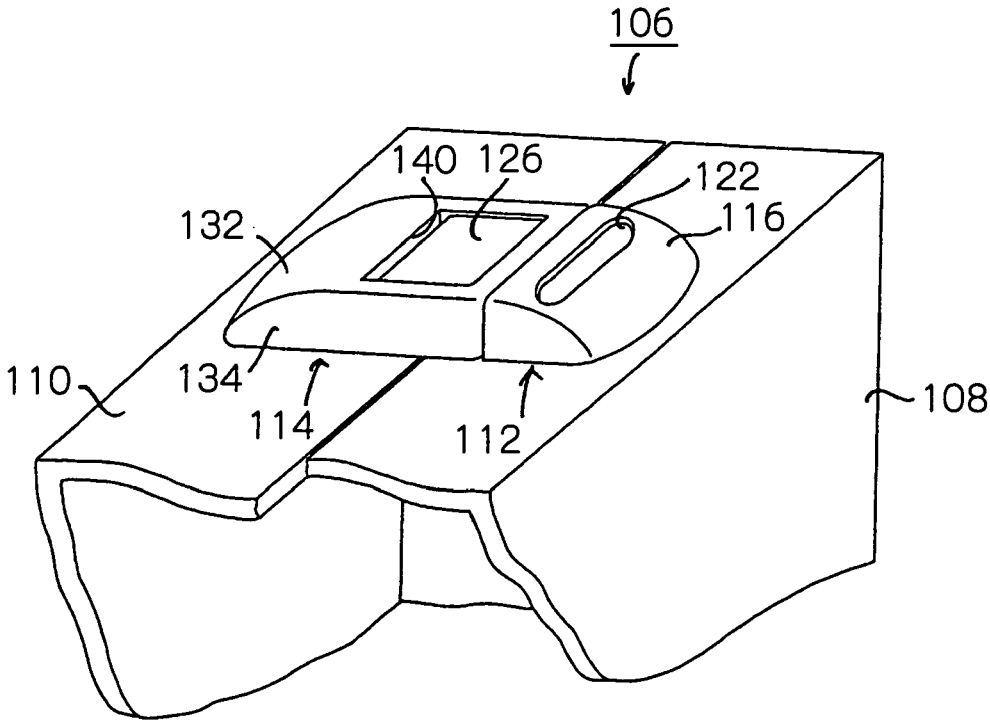
FIG. 16 is a view similar to that of FIG. 15, but with the attache case in its closed or latched position.

Referring now to FIGS. 15 and 16, there is shown a magnetic latch assembly according to a fourth embodiment of the present invention, as applied to an attache case 106. The attache case 106 has a rectangular shape and includes a lid shell 108 and a base shell 110 connected to the lid shell 108 by conventional hinges (not shown). In the illustrated embodiment, the lid shell 108 is provided with a first latch means 112, and the base shell 110 is provided with a second latch means 114. The base shell 110 is provided with a handle (not shown) between the first and second latch means.

The first latch means 112 includes a latch mount 116 secured to the top surface of the lid shell 108, and a movable latch member 118 partly extending out of the latch mount 116. The latch mount 116 includes a vertical front wall 116*a*, a bottom wall 116*b* secured to the top surface of the lid shell 108, upstanding opposite side walls 116*c* (only one is shown in FIGS. 15 and 16), and a top wall 116*d*, and a round rear wall 116*e*. A front recess 120 is defined in the front wall 116*a* of the latch mount 116. A pair of vertical guide grooves 122 are defined in the latch mount 116 and located at opposite sides of the front recess 120. The latch member 118 includes an elongated latch arm 124, a rectangular hook 126 arranged on the distal end of the latch arm 124, and opposite ellipsoidal elements or holders 128 extending upwardly from the proximal end of the latch member 118 and movably disposed within the respective guide grooves 122. The ellipsoidal elements 128 serve to constantly hold the latch member 118 in a horizontal orientation and prevent removal of the latch member 118 from the latch mount 116. A rectangular magnet 130 is embedded in the hook 126.

Figure 18:
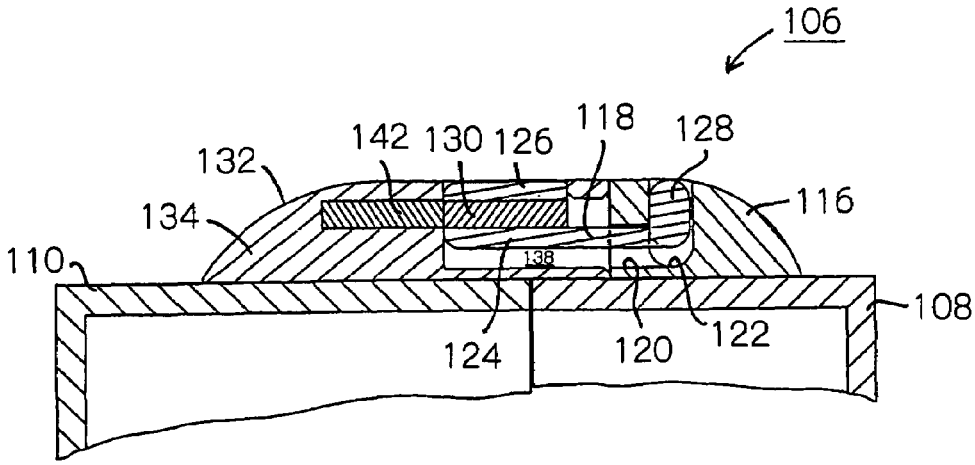
FIG. 18 is a sectional view of the magnetic latch assembly shown in FIG. 16.

The second latch means 114 is in the form of a retainer 132. The retainer 132 includes a housing 134 secured to the top surface of the base shell 110 and partly extending outwardly from the front edge of the base shell 110. The retainer 132 is formed at its front end with a front opening 136 which is shaped to receive the latch member 118. The retainer 132 also includes a L-shaped cavity 138 composed of a horizontal passage 138*a* communicated with the opening 136 and a vertical passage 138*b* extending vertically upwardly from the inner end of the horizontal passage 138*a*. An access aperture 140 is defined in the top surface of the housing 134 and communicated with the vertical passage 138*b*. The top aperture 140 allows the user to gain access to the hook 126 of the latch member 118 when the attache case is in its latched position as shown in FIGS. 16 and 18. A rectangular magnet 142 is horizontally embedded in the retainer 132 behind the cavity 138 and has a magnetic pole of opposite polarity from the magnetic pole of the magnet 130.

Figure 17:
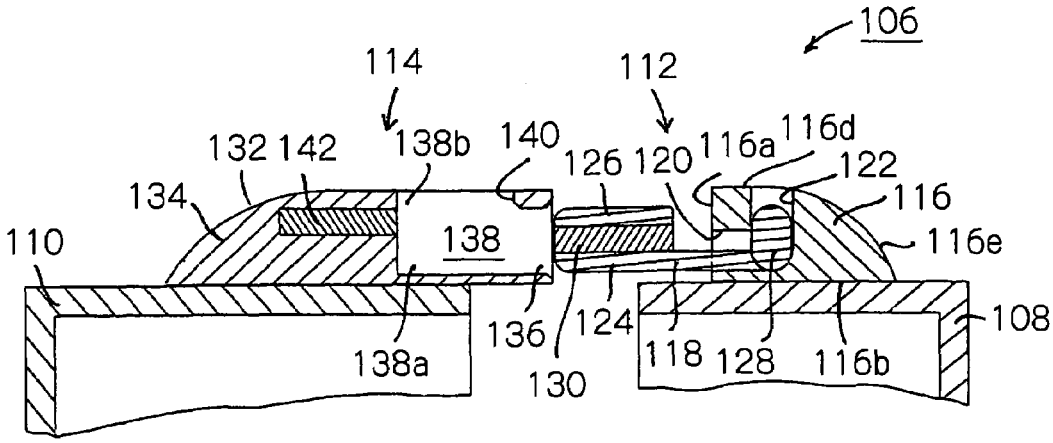
FIG. 17 is a sectional view of the magnetic latch assembly shown in FIG. 15.

To latch the attache case from the position shown in FIGS. 15 and 17, the lid shell 108 is moved toward the base shell 110. Further movement of the lid shell 108 causes the latch member 118 to be inserted into the cavity 138 through the front opening 136 of the retainer 132. Once the distal end of the latch member 118 makes contact with the rear wall of the cavity 138, the attractive force between the magnets 130, 142 causes upward movement of the latch member 118 within the cavity 138. With the attache case in its latched position shown in FIGS. 16 and 18, the magnets 130, 142 are attracted to each other, and the hook 126 of the latch member 118 is engaged with the front wall or retaining end of the retainer. In this position, the top surface of the hook 126 is substantially flush with the top surface of the retainer housing 134.

To unlatch the attache case, the top surface of the hook 126 is manually pushed down with sufficient force to disengage the magnet 130 from the magnet 142. This causes downward movement of the latch member 118 within the cavity 138 until the bottom of the latch arm 124 is brought into contact with the bottom surface of the cavity 138. This allows the latch member 118 to be moved away from the cavity 138. As the lid shell 108 is pivoted away from the base shell 110, the latch member 118 is slid out of the cavity 138 through the front opening 136.

Although the present invention has been described with respect its preferred embodiments, it is to be understood that various changes and modifications may be made without departing from the scope of the invention as defined by the appended claims.

What is claimed is:

1. A magnetic latch assembly comprising:

a first object;

a second object movable relative to said first object;

a first latch means arranged in said first object; and a second latch means arranged in said second object, said first and second latch means being operatively associated to secure said first and second objects together;

said first latch means including a latch member movably mounted to said first object and a first magnet arranged in said latch member and having a first magnetic pole;

said second latch means including a housing arranged in said second object and having a retaining end, a cavity defined within said housing and having a first passage and a second passage extending in a direction substantially perpendicular to the direction in which said first passage extends, and a second magnet provided in said housing;

said latch member being inserted into said first passage when said first and second objects are relatively moved toward each other;

said second magnet having a second magnetic pole of opposite polarity from said first magnetic pole of said first magnet, said first magnet and said second magnet being operatively associated to force said latch member to move from said first passage into said second passage when said latch member is inserted into said first passage and to urge said latch member into latching engagement with said retaining end of said housing.

2. The assembly of claim 1, wherein said latch member includes an elongated latch arm having a proximal end supported by said first object and a distal end, and a hook arranged in said distal end of said latch arm and shaped to receive said first magnet.

3. The assembly of claim 2, wherein said first latch means comprises a recess defined in said first object, and a first guide groove defined in said first object and adapted to guide said latch member during movement of said latch member within said recess, said first guide groove extending in a direction substantially parallel to said second passage of said cavity when said latch member is latchingly engaged with said retaining end.

4. The assembly of claim 3, wherein said first latch means further comprises a second guide groove defined in said first object and extending in a direction substantially perpendicular to said first guide groove.

5. The assembly of claim 2, wherein said first latch means comprises a recess defined said first object, and said latch member is pivotably moved between a first position wherein said latch member is contained within said recess and a second position wherein said latch member is aligned with said first passage of said cavity.

6. The assembly of claim 1, wherein said second magnet is contained in said housing adjacent to said cavity.

7. The assembly of claim 6, wherein said housing has a through aperture communicated with said cavity so that said latch member is accessible through said aperture.

8. The assembly of claim 6, wherein said housing has a through aperture, further comprising a release member extending through said aperture and engaged with said latch member when said latch member is latchingly engaged with said retaining end of said housing.

9. The assembly of claim 1, wherein said housing has a through bore communicated with said cavity, further comprising a release member shaped to receive said second magnet and movably received in said through bore to allow selective engagement between said first and second magnets.

* * * * *

UNITED STATES PATENT AND TRADEMARK OFFICE

CERTIFICATE OF CORRECTION

PATENT NO. : 7,234,739 B2
APPLICATION NO. : 11/053873
DATED : June 26, 2007
INVENTOR(S) : Saitoh et al.

It is certified that error appears in the above-identified patent and that said Letters Patent is hereby corrected as shown below:

Column 1:
Line 6, change “particularly to, a” to -- particularly to a --.
Line 44, change “Many of conventional” to -- Many conventional --; change “are complicate” to -- are complicated --.
Line 57, change “objects such as” to -- objects, such as --.

Column 3:
Line 24 and Line 26, change “attache case” to -- attaché case --.
Line 57, change “taper outer edges” to -- tapered outer edges --.

Column 4:
Line 5, change “a horizontal top” to -- horizontal top --.
Line 14, change “a taper peripheral” to -- a tapered peripheral --.
Line 16, change “first, horizontal passage” to -- first, horizontal, passage --.
Line 17, change “second, vertical passage” to -- second, vertical, passage --.
Line 24 and Line 26, change “cross sectional area” to -- cross-sectional area --.

Column 5:
Line 32, change “is mounted on” to -- is mounted --.
Line 34, change “mounted on near” to -- mounted near --.
Line 45, change “and therefore, will” to -- and, therefore, will --.
Line 52, change “housing 52 has a” to -- housing 52 has an --.

Column 6:
Line 1 and Lines 3-4, change “cross sectional area” to -- cross-sectional area --.

Column 7:
Line 10, change “taper outer edges” to -- tapered outer edges --.
Line 20, change “includes a” to -- includes an --.
Line 52, change “is manually press” to -- is manually pressed --.
Line 62 and Line 63, change “attache case” to -- attaché case --.

Column 8:
Line 30, change “includes a L-shaped” to -- includes an L-shaped --.
Line 37, Line 43, Line 51, and Line 58, change “attache case” to -- attaché case --.

Column 9:
Line 15, change “said first object and” to -- said first object, and --.

UNITED STATES PATENT AND TRADEMARK OFFICE

CERTIFICATE OF CORRECTION

PATENT NO. : 7,234,739 B2
APPLICATION NO. : 11/053873
DATED : June 26, 2007
INVENTOR(S) : Saitoh et al.

It is certified that error appears in the above-identified patent and that said Letters Patent is hereby corrected as shown below:

Column 10:
Line 15, change "a recess defined said" to --a recess defined in said --.

Signed and Sealed this

Twenty-seventh Day of November, 2007

JON W. DUDAS
*Director of the United States Patent and Trademark Office*